US011421538B2

(12) United States Patent
Heeter et al.

(10) Patent No.: US 11,421,538 B2
(45) Date of Patent: Aug. 23, 2022

(54) COMPOSITE AEROFOILS

(71) Applicant: Rolls-Royce Corporation, Indianapolis, IN (US)

(72) Inventors: Robert Heeter, Noblesville, IN (US); Matthew J. Kappes, Greenwood, IN (US); Jonathan Michael Rivers, Indianapolis, IN (US); Benedict N. Hodgson, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 85 days.

(21) Appl. No.: 15/930,158

(22) Filed: May 12, 2020

(65) Prior Publication Data

US 2021/0355833 A1 Nov. 18, 2021

(51) Int. Cl.
*F01D 9/02* (2006.01)
*F01D 5/28* (2006.01)

(52) U.S. Cl.
CPC ..... *F01D 5/282* (2013.01); *F01D 9/02* (2013.01); *F05D 2220/323* (2013.01);
(Continued)

(58) Field of Classification Search
CPC ..... F01D 5/282; F01D 9/02; F05D 2220/323; F05D 2230/31; F05D 2240/128;
(Continued)

(56) References Cited

U.S. PATENT DOCUMENTS 4,957,415 A 9/1990 Paul et al.
5,182,906 A 2/1993 Gilchrist et al.
(Continued)

FOREIGN PATENT DOCUMENTS

DE 102010005897 A1 2/2011
WO 2015142395 A2 9/2015

OTHER PUBLICATIONS

Corporate Technologies, Innegra Technologies, 2014 (Applicant points out, in accordance with MPEP 609.04(a), that the year of publication, 2014, is sufficiently earlier than the effective U.S. filing dale, 2017, so that the particular month of publication is not in issue.) 24 pp.

(Continued)

*Primary Examiner* — J. Todd Newton
*Assistant Examiner* — Theodore C Ribadeneyra
(74) *Attorney, Agent, or Firm* — Shumaker & Sieffert, P.A.

(57) ABSTRACT

A composite aerofoil may include an aerofoil body defining a leading edge and a trailing edge, wherein the body comprises a composite material including a plurality of relatively higher-modulus reinforcement elements, a plurality of relatively tougher polymer-based reinforcement elements, and a matrix material substantially encapsulating the plurality of relatively higher-modulus reinforcement elements and the plurality of relatively tougher polymer-based reinforcement elements. The plurality of relatively higher-modulus reinforcement elements are different from the plurality of relatively tougher polymer-based reinforcement elements. The disclosure also describes techniques for forming composite aerofoils.

19 Claims, 8 Drawing Sheets

(52) U.S. Cl.
CPC .... *F05D 2230/31* (2013.01); *F05D 2240/128* (2013.01); *F05D 2240/303* (2013.01); *F05D 2240/304* (2013.01); *F05D 2300/433* (2013.01); *F05D 2300/6031* (2013.01)

(58) Field of Classification Search
CPC ..... F05D 2240/303; F05D 2240/304; F05D 2300/433; F05D 2300/6031
See application file for complete search history.

(56) References Cited

U.S. PATENT DOCUMENTS 5,217,283 A 6/1993 Watanabe
5,252,160 A 10/1993 Scanlon et al.
6,358,014 B1 3/2002 Chou et al.
6,416,280 B1 7/2002 Forrester et al.
6,447,255 B1 9/2002 Bagnall et al.
6,561,763 B2 5/2003 Breakwell
6,942,462 B2 9/2005 Breakwell et al.
8,092,183 B2 1/2012 Borzakian et al.
8,292,586 B2 10/2012 Bottome
8,425,197 B2 4/2013 Breakwell
8,529,204 B2 9/2013 Bagnall
8,596,981 B2 12/2013 Hoyland et al.
8,616,849 B2 12/2013 Menheere et al.
8,677,622 B2 3/2014 Schreiber
8,696,319 B2 * 4/2014 Naik ..... B29B 11/16 416/230
8,753,094 B2 6/2014 Bottome
8,827,651 B2 9/2014 Bottome
8,911,656 B2 12/2014 Doddman et al.
9,017,031 B2 4/2015 Bottome
9,200,595 B2 12/2015 Bottome
9,228,444 B2 1/2016 Evans et al.
9,410,431 B2 8/2016 Bottome et al.
9,481,448 B2 11/2016 Totten et al.
9,682,450 B2 6/2017 Tomeo et al.
9,739,162 B2 8/2017 Bottome et al.
9,752,449 B2 9/2017 Bottome et al.
2001/0031594 A1 10/2001 Perez et al.
2005/0053466 A1 * 3/2005 Finn ..... F04D 29/324 416/230
2006/0275132 A1 * 12/2006 McMillan ..... F01D 5/282 416/224
2010/0015394 A1 * 1/2010 Morrison ..... F01D 5/282 428/137
2010/0028594 A1 * 2/2010 Kray ..... F01D 5/282 428/114
2011/0038732 A1 * 2/2011 Huth ..... F01D 5/282 416/229 A
2011/0142670 A1 * 6/2011 Pilpel ..... F01D 5/282 416/230
2011/0164986 A1 * 7/2011 Roberts ..... F01D 5/282 416/230
2011/0176927 A1 * 7/2011 Alexander ..... F04D 29/023 416/230
2012/0009071 A1 * 1/2012 Tanahashi ..... F01D 5/282 416/241 B
2012/0034089 A1 * 2/2012 Wadewitz ..... B29C 70/24 416/223 R
2012/0051935 A1 * 3/2012 Naik ..... F04D 29/023 416/230
2012/0134839 A1 * 5/2012 Parkin ..... B32B 5/26 416/230
2012/0244003 A1 9/2012 Mason
2012/0257983 A1 * 10/2012 Williams ..... F01D 5/288 416/230
2012/0263596 A1 10/2012 Evans et al.
2013/0004325 A1 * 1/2013 McCaffrey ..... C04B 35/584 416/241 B
2013/0105031 A1 * 5/2013 Dambrine ..... B21K 3/04 139/383 R
2013/0224035 A1 * 8/2013 Alexander ..... B29D 99/0025 416/230
2013/0259701 A1 * 10/2013 Dambrine ..... F04D 29/324 416/229 R
2013/0276459 A1 * 10/2013 Roberts ..... F01D 5/282 60/805
2014/0030076 A1 * 1/2014 Nunez ..... C04B 35/62884 415/183
2014/0072443 A1 * 3/2014 Mateo ..... D03D 25/005 416/241 R
2014/0086751 A1 3/2014 Bottome et al.
2014/0133989 A1 * 5/2014 Belmonte ..... C04B 35/571 416/204 A
2014/0161621 A1 * 6/2014 Kray ..... F01D 5/147 416/226
2014/0186166 A1 7/2014 Kostka
2014/0255202 A1 9/2014 Kling et al.
2014/0286765 A1 * 9/2014 Hoyland ..... F01D 9/02 415/200
2014/0363304 A1 * 12/2014 Murooka ..... F04D 29/388 416/229 R
2015/0040396 A1 * 2/2015 Fremont ..... C04B 35/80 29/889.71
2015/0044050 A1 * 2/2015 Thomas ..... F01D 5/282 416/182
2015/0044056 A1 * 2/2015 Hodgson ..... F01D 5/146 416/224
2015/0132134 A1 5/2015 Murdock
2015/0165571 A1 * 6/2015 Marchal ..... B23P 15/02 29/889.6
2015/0198174 A1 7/2015 Houle
2015/0224719 A1 * 8/2015 Eyb ..... B29C 44/5618 416/241 A
2015/0226071 A1 * 8/2015 Marshall ..... F01D 5/187 416/230
2015/0292340 A1 * 10/2015 Kawanishi ..... F01D 5/3007 416/215
2015/0300194 A1 10/2015 Bottome et al.
2015/0377045 A1 * 12/2015 Chang ..... F01D 5/284 415/200
2016/0010459 A1 1/2016 Romanowski et al.
2016/0032939 A1 * 2/2016 Anderson ..... B29C 70/34 416/230
2016/0076552 A1 * 3/2016 Anderson ..... F04D 29/324 416/230
2016/0101591 A1 * 4/2016 Khan ..... B32B 37/142 428/113
2016/0108741 A1 * 4/2016 Jevons ..... F01D 5/147 416/230
2016/0108746 A1 * 4/2016 Riehl ..... F01D 5/284 60/805
2016/0130952 A1 * 5/2016 Voleti ..... F04D 29/023 415/200
2016/0146021 A1 * 5/2016 Freeman ..... F01D 5/18 416/95
2016/0153295 A1 * 6/2016 Pautard ..... F01D 5/282 415/200
2016/0177743 A1 * 6/2016 Thomas ..... F01D 5/18 416/230
2016/0312626 A1 * 10/2016 Schetzel ..... F01D 5/225
2017/0275210 A1 * 9/2017 Corman ..... C04B 35/573
2017/0282466 A1 * 10/2017 Backhouse ..... B29C 70/382
2017/0328223 A1 * 11/2017 Subramanian ..... B32B 18/00
2018/0036914 A1 * 2/2018 Marsal ..... D03D 25/005
2018/0038382 A1 * 2/2018 Foster ..... F01D 5/10
2018/0038385 A1 * 2/2018 Welch ..... B22F 7/06
2018/0045207 A1 * 2/2018 Paquin ..... B32B 3/263
2018/0051705 A1 * 2/2018 Foster ..... F01D 5/282
2018/0065337 A1 * 3/2018 Grasso ..... B32B 15/04

OTHER PUBLICATIONS

Final Report Summary—ORCA (Development of an Optimized Large Scale Engine CFRP annulus filler), retrieved from hllps://cordis.europa.eu/resull/rcn/147995_en.html, Jul. 13, 2018, 3 pp.
Olefin-Carbon Fiber Hybrid Wins JEC Innovation Award, plasticstoday.com, Oct. 3, 2013, 2 pp.

(56) References Cited

OTHER PUBLICATIONS

Black, "Automotive Composites: Thermosets for the Fast Zone," compositesworld.com, Aug. 31, 2015, 6 pp.
Gardiner, "HP-RTM on the Rise," compositesworld.com, Apr. 14, 2015, 6 pp.
Horejsi et al., "FACC AG & CleanSky," CleanSky, Jan. 2011, 18 pp.
Meister et al., "Switzerland: The Engine of the Future," maschinenmarkt, Jan. 20, 2016,2 pp.
Sloan et al., "GE Aviation, Batesville, MS, US," compositesworld.com, Feb. 8, 2016, 5 pp.
"Fiber," https://www.thefreedictionary.com/fiber, retrieved on Mar. 31, 2020, 6 pp.

* cited by examiner

COMPOSITE AEROFOILS

TECHNICAL FIELD

The present disclosure relates to composite aerofoils for gas turbine engines.

BACKGROUND

Gas turbine engines used to propel vehicles, e.g., aircraft, often include a fan assembly that is driven by an engine core. The fan assembly blows air to provide thrust for moving the aircraft. Fan assemblies typically include a bladed wheel mounted to a shaft coupled to the engine core and a nosecone or spinner mounted to the bladed wheel to rotate with the bladed wheel. The bladed wheel of the fan assembly may include a plurality of aerofoils in the form of fan blades coupled to a fan disc. In some examples, gas turbine engines may also include aerofoils in the form of circumferentially spaced radially extending outlet guide vanes (OGVs) located aft of the bladed wheel.

SUMMARY

The disclosure describes composite aerofoils and techniques for forming composite aerofoils. A composite aerofoil as described herein may include an aerofoil body formed from a composite material, which includes a matrix material, relatively higher-modulus reinforcement elements and relatively tougher polymer-based reinforcement elements. Such composite aerofoils may be relatively lightweight, yet tough (e.g., reduced brittleness) to increase resistance to fracturing when struck by a foreign object.

In some examples, the disclosure describes an aerofoil body defining a leading edge and a trailing edge, wherein the body comprises a composite material including a plurality of relatively higher-modulus reinforcement elements, a plurality of relatively tougher polymer-based reinforcement elements, and a matrix material substantially encapsulating the plurality of relatively higher-modulus reinforcement elements and the plurality of relatively tougher polymer-based reinforcement elements. The plurality of relatively higher-modulus reinforcement elements are different from the plurality of relatively tougher polymer-based reinforcement elements.

In some examples, the disclosure describes a method of constructing a composite aerofoil. The method includes defining an aerofoil body shape with a matrix material, a plurality of relatively higher-modulus reinforcement elements, and a plurality of relatively tougher polymer-based reinforcement elements. The plurality of relatively higher-modulus reinforcement elements are different from the plurality of relatively tougher polymer-based reinforcement elements, and the aerofoil body is configure to define a leading edge and a trailing edge. The method also includes curing the matrix material substantially encapsulating the plurality of relatively higher-modulus reinforcement elements and the plurality of relatively tougher polymer-based reinforcement elements to form the aerofoil body.

The details of one or more examples are set forth in the accompanying drawings and the description below. Other features, objects, and advantages will be apparent from the description and drawings, and from the claims.

DETAILED DESCRIPTION

Figure 1:
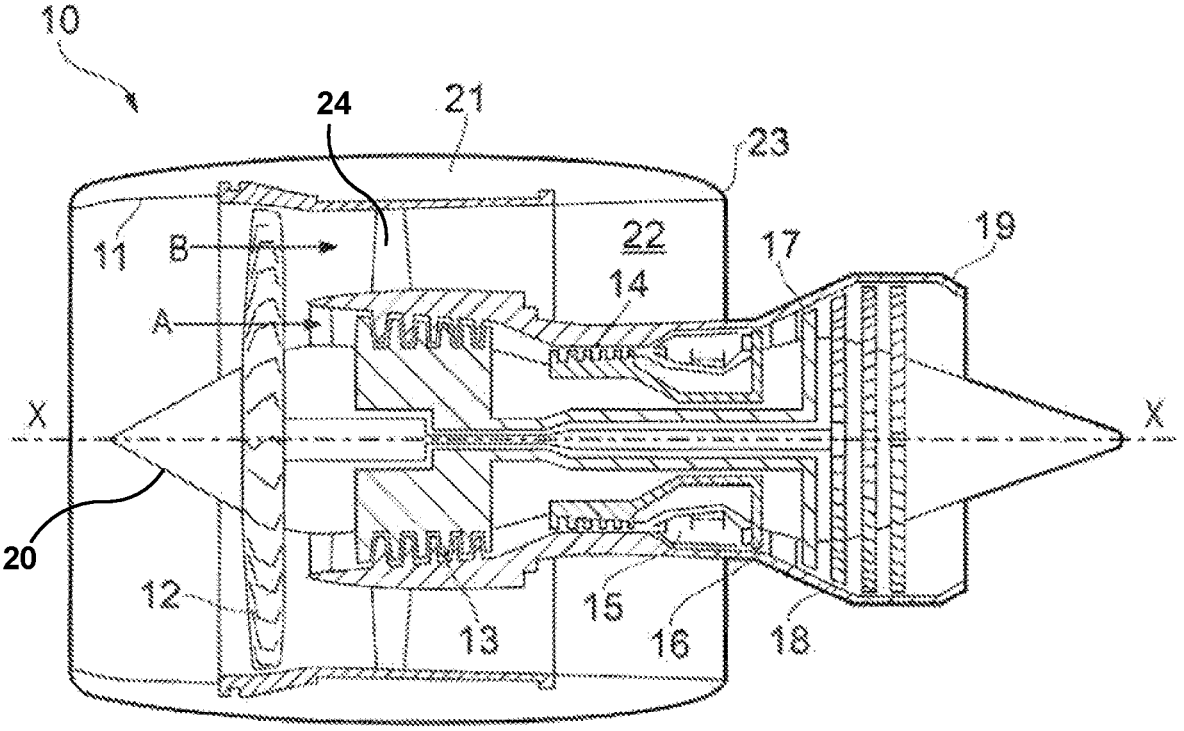
FIG. 1 is a schematic diagram illustrating a longitudinal cross-section view of an example high-bypass gas turbine engine.

The disclosure describes composite aerofoils, e.g., for use in gas turbine engines, and techniques for forming composite aerofoils. Example aerofoils employed in gas turbine engines may include fan blades and vanes (e.g., as employed in turbofan engines), and propellers (e.g., as employed in turboprop engines). Example vanes include outlet guide vanes, inlet guide vanes, and integrated strut-vane nozzles.

In operation, such aerofoils may experience impact damage, which may be referred to foreign object damage (FOD) and may be caused by hailstrikes, birdstrikes or the like. Damage to the aerofoil may cause the aerofoil to fail, potentially causing an incident, or to be repaired or replaced entirely, which may result in the engine and airframe on which the engine is mounted being out of service during the repairs. The service time may lead to customer frustration due to the downtime and increased service expenses. One option for increasing strength and toughness of aerofoils is to include additional material, e.g., in the form of reinforcement elements. However, this increases weight of the aerofoils, which may lead to other undesirable effects.

Described herein are composite aerofoils that include a matrix material, a plurality of relatively higher-modulus reinforcement elements, and a plurality of relatively tougher polymer-based reinforcement elements. The relatively higher-modulus reinforcement elements have a higher tensile modulus compared to the relatively tougher polymer-based reinforcement elements. The relatively tougher polymer-based reinforcement elements have a reduced brittleness compared to the relatively higher-modulus reinforcement elements. In some examples, a relatively higher-modulus reinforcement element may have a tensile modulus (e.g., Young's modulus or elastic modulus) of at least about 60 GPa, and a relatively tougher polymer-based reinforcement element may have a strain elongation at break of greater than about 6.0%. Example relatively higher-modulus reinforcement elements include, but are not limited to, aramid fibers, carbon fibers, glass fibers, or the like. Example relatively tougher polymer-based reinforcement elements include, but are not limited to, polypropylene fibers, polyester fibers, high performance polyethylene fibers, or the like. Such composite aerofoils may be relatively lightweight. Additionally, by including relatively tougher polymer-based reinforcement elements in addition to relatively higher-modulus reinforcement elements, the composite aerofoil may exhibit increased toughness (e.g., reduced brittleness), which may increase resistance to fracturing or other damage when struck by a foreign object, such as birds, hailstones, or the like.

A composite aerofoil includes an aerofoil body, which defines a leading edge, a trailing edge, a pressure side extending between the leading edge and the trailing edge, and a suction side extending between the leading edge and the trailing edge. The aerofoil body extends from a root to a tip. The composite aerofoil may be configured to be mounted on a wheel or disk (in examples in which the composite aerofoil is a fan blade or propeller) or may be configured to be mounted to a casing or stator (in examples in which the composite aerofoil is an outlet guide vane).

The composite aerofoil includes one or more layers of reinforcement elements substantially encapsulated in a matrix material. Each layer of the one or more layers of reinforcement elements may include a layer of relatively higher-modulus reinforcement elements, a layer of relatively tougher polymer-based reinforcement elements, or a layer including both relatively higher-modulus reinforcement elements and relatively tougher polymer-based reinforcement elements.

In some examples, a composite aerofoil may include regions that include different ratios of relatively tougher polymer-based reinforcement elements to relatively higher-modulus reinforcement elements. For example, a region near and including the trailing edge may include a greater ratio of relatively tougher polymer-based reinforcement elements to relatively higher-modulus reinforcement elements than a region near and including the leading edge. As another example, an outer skin region of the aerofoil may include a higher ratio of relatively tougher polymer-based reinforcement elements to relatively higher-modulus reinforcement elements. A higher ratio of relatively tougher polymer-based reinforcement elements in a region may result in added toughness compared to regions with a lower ratio of relatively tougher polymer-based reinforcement elements. On the other hand, a higher ratio of relatively higher-modulus reinforcement elements to relatively tougher polymer-based reinforcement elements may result in greater strength but also increased brittleness.

In some examples, the reinforcement elements included in the composite materials are arranged into two-dimensional or three-dimensional reinforcement architectures. The relatively tougher polymer-based reinforcement elements may be separate from, intermingled with, braided with, or interwoven with along with the relatively higher-modulus reinforcement elements, depending on the particular properties selected for a particular region of the composite aerofoil. For example, an individual braid or weave may include a plurality of strands. Each strand of the plurality of strands includes one or more tows (e.g., yarns). Each tow includes a plurality of fibers. A pure unidirectional (UD) tape, pure braid, or pure weave includes only strands having one or more tows that include only fibers of the same material. A hybrid braid or hybrid weave include at least one first strand having one or more tows that include fibers of a first material and a second strand having one or more tows that include fibers of a second, different material. A hybrid braid or hybrid weave may include more than two types of strands, each strand intermingled by having one or more tows including a different type of fiber. A commingled braid, commingled weave, or commingled tape includes at least one strand having at least one first tow that includes fibers of a first material and at least one second tow that includes fibers of a second, different material. The weaving can occur in 2D (fabric layers that are stacked on each other) or in 3D (roving fibers that are through multiple layers of wefts). Alternatively, the mixture of reinforcement elements can be accomplished with different layers of UD tape, one with high modulus fiber and another with high toughness fiber. As another example, the UD tapes may be hybrid or commingled within a single layer.

FIG. 1 is a schematic diagram illustrating a longitudinal cross-section view of an example high-bypass gas turbine engine 10. The central axis (e.g., principal and rotational axis) of rotating elements of gas turbine engine 10 is the X-X axis. Gas turbine engine 10 includes an air intake 11, a fan 12, and a core flow system A. The fan 12 includes rotor blades which are attached to a rotor disc. Nosecone 20 may be mounted to fan 12. The core flow system A includes an intermediate-pressure compressor 13, a high-pressure compressor 14, a combustion chamber 15, a high-pressure turbine 16, an intermediate-pressure turbine 17, a low-pressure turbine 18, and a nozzle 19. Furthermore, outside the core flow system A, the gas turbine engine includes bypass flow system B. The bypass flow system B includes a nacelle 21, a fan bypass 22, and a fan nozzle 23. In other examples, high-bypass gas turbine engine 10 may include few components or additional components.

Thrust, which propels an aircraft, is generated in a high-bypass gas turbine engine 10 by both the fan 12 and the core flow system A. Air enters the air intake 11 and flows substantially parallel to central axis X-X past the rotating fan 12, which increases the air velocity to provide a portion of the thrust. Outlet guide vanes 24 may be positioned aft of fan 12 to interact with air flowing through bypass flow system B. In some examples, outlet guide vanes 24 may be positioned closer to fan 12. A first portion of the air that passes between the rotor blades of the fan 12 enters the core flow system A, while a second portion enters the bypass flow system B. Air that enters the core flow system A is first compressed by intermediate-pressure compressor 13, then high-pressure compressor 14. The air in core flow system A enters combustion chamber 15, where it is mixed with fuel and ignited. The air that leaves the combustion chamber 15 has an elevated temperature and pressure compared to the air that first entered the core flow system A. The air with elevated temperature and pressure produces work to rotate, in succession, high-pressure turbine 16, intermediate-pressure turbine 17, and low-pressure turbine 18, before ultimately leaving the core flow system A through nozzle 19. The rotation of turbines 16, 17, and 18 rotates high-pressure compressor 14, intermediate pressure compressor 13, and fan 12, respectively. Air that passes through bypass flow system B does not undergo combustion or further compression and does not produce work to rotate turbines 16, 17, and 18, but contributes propulsive thrust to gas turbine engine 10.

In accordance with examples of the disclosure, at least one of fan 12 or outlet guide vanes 24 includes a composite aerofoil. The composite aerofoil may include a matrix material, a plurality of relatively tougher polymer-based reinforcement elements, and a plurality of relatively higher-modulus reinforcement elements. The plurality of relatively higher-modulus reinforcement elements is different from the plurality of relatively tougher polymer-based reinforcement elements. The relatively higher-modulus reinforcement elements have a higher tensile modulus than the relatively tougher polymer-based reinforcement elements. In this way, the relatively higher-modulus reinforcement elements contribute to the strength of the composite aerofoil. The relatively tougher polymer-based reinforcement elements have a higher strain elongation at break than the relatively higher-modulus reinforcement elements. In this way, the relatively tougher polymer-based reinforcement elements contribute to the toughness of the composite aerofoil.

The matrix material may include a polymer configured to substantially surround the relatively higher-modulus reinforcement elements and relatively tougher polymer-based reinforcement elements. The matrix material includes a polymer. For example, the matrix material may include a thermoset polymer, including but not limited to, an epoxy. In some examples, the matrix material may be a polymer that cures at a relatively low temperature, such as less than about 150° C. For example, the matrix material may include CYCOM® 823® (cures at a temperature of about 125° C. in about 1 hour), available from Cytec Solvay Group, Brussels, Belgium; HexPly® M77 (cures at a temperature of about 150° C. in about 2 minutes), HexPly® M76, or HexPly® M92 available from HEXCEL® Corporation, Stamford, Conn.; TC250 (cures at a temperature of about 130° C. in about 2 hours) available from TenCate Advanced Composites, Morgan Hill, Calif.; and Nelcote® E-765 (cures at a temperature of about 135° C. in about 2 hours) available from Park Electrochemical Corp, Melville, N.Y. By curing at a relatively low temperature, the composite aerofoil may include relatively tougher polymer-based reinforcement elements that undergo thermal degradation (or are otherwise altered) at relatively higher temperatures (e.g., greater than about 150° C.). In some examples, different matrix materials may be used in region(s) of the composite aerofoil that include a higher ratio of relatively tough polymer-based reinforcement elements than in region(s) of the composite aerofoil that include a lower ratio of relatively tough polymer-based reinforcement elements. For instance, some relatively high modulus reinforcement elements may be compatible with higher temperature processing while some relatively tougher polymer-based reinforcement elements may be incompatible with higher temperature processing. To combine these different laminates together, an epoxy film adhesive may be utilized to create one aerofoil after separately curing the different portions. This may include a tougher fiber core with a stiffer and stronger but more brittle fiber outer surface.

The relatively higher-modulus reinforcement elements may include continuous fibers. In some examples, the relatively higher-modulus reinforcement elements have a relatively high tensile modulus, such as greater than 60 GPa. Example reinforcement elements that have an a tensile modulus of greater than 60 GPa include aromatic polyamide fibers, such as Kevlar®, available from E.I. du Pont de Nemours and Company, Wilmington, Del.; carbon fibers, such as carbon fibers derived from polyacrylonitrile fibers; and some glass fibers, such as E-glass (an alumino-borosilicate glass with less than 1% weight-per-weight alkali oxides) or S-glass (an alumino silicate glass excluding CaO and including MgO). In some examples, the tensile modulus of the relatively higher-modulus reinforcement element is greater than about 90 GPa, or greater than about 120 GPa, or greater than about 180 GPa, or greater than about 200 GPa. For example, some carbon fibers have a tensile modulus of between about 225 GPa and about 300 GPa.

In some examples, the relatively higher-modulus reinforcement elements may be relatively brittle, e.g., exhibit a relatively low elongation at break. For example, the relatively higher-modulus reinforcement elements may have an elongation at break of less than about 6.0%. In some examples, the elongation at break is lower than 6.0%, such as less than about 5.0%, or less than about 2.0%. Because of this, while the composite aerofoil including a matrix material and relatively higher-modulus reinforcement elements may provide significant stiffness and tensile strength to the composite aerofoil, the impact resistance of the composite aerofoil that includes only a matrix material and relatively higher-modulus reinforcement elements may be relatively low due to the brittleness of the relatively higher-modulus reinforcement elements, and the composite aerofoil may suffer brittle failure upon impact from a foreign object, such as a bird, hailstones, or the like. Further, the relatively higher-modulus reinforcement elements may be relatively dense. For example, carbon fibers may have a density of around 1.8 g/cm$^3$, aromatic polyamide fibers may have a density of around 1.4-1.5 g/cm$^3$, and glass fibers may have a density of greater than 2.0 g/cm$^3$. For these reasons, the composite aerofoil includes relatively tougher polymer-based reinforcement elements in addition to relatively higher-modulus reinforcement elements.

The relatively tougher polymer-based reinforcement elements have an elongation at break of greater than 6.0%. By exhibiting a higher elongation at break than the relatively higher-modulus reinforcement elements, the relatively tougher polymer-based reinforcement elements contribute greater toughness to the composite aerofoil. For example, the composite aerofoil with relatively tougher polymer-based reinforcement elements is more resistant to impact damage, such as damage due to impact from a foreign object, such as a bird, a hailstone, or the like.

In some examples, the relatively tougher polymer-based reinforcement elements have an elongation at break that is greater than that of the matrix material. For example, the elongation at break of the relatively tougher polymer-based reinforcement elements is greater than about 6.0%, such as greater than about 10.0%, greater than about 15.0%, greater than about 20.0%, or greater than about 25.0%. The greater elongation at break of the relatively tougher polymer-based reinforcement elements (compared to the relatively higher-modulus reinforcement elements) allows the relatively tougher polymer-based reinforcement elements to provide at least some structural integrity to the composite aerofoil even if the matrix material cracks or delaminates from the reinforcement fibers.

The relatively tougher polymer-based reinforcement elements may include, for example, a polyamide; a polyester or polyester terephthalate (PET), such as Dacron®, available from IVISTA, Wichita, Kans., or Vectran®, available from Kuraray Co., Ltd., Tokyo, Japan; a polypropylene, such as a high modulus polypropylene (HMPP), for example Innegra™ S, available from Innegra Technologies™, Greenville S.C.; a polyethylene, such as high density polyethylene, high performance polyethylene, or ultra-high molecular weight polyethylene; spider silk; or the like.

The reinforcement elements may be incorporated in the composite aerofoil in any desired manner. Each respective reinforcement element may include relatively higher-modulus elements, relatively tougher polymer-based elements, or both. The plurality of relatively higher-modulus reinforcement elements and the plurality of relatively tougher polymer-based reinforcement elements may define at least one reinforcement architecture. A reinforcement architecture includes a particular combination and physical arrangement of materials, such as a matrix material and at least one of a plurality of relatively higher-modulus reinforcement elements or a plurality of relatively tougher polymer-based reinforcement elements. The reinforcement architecture may include strands, braids, weaves, tape, fabric layers, or the like. As discussed above, strands include one or more tows, and tows include a plurality of fibers. Strands may be configured to form each respective reinforcement including, as discussed above, a pure braid, a pure weave, a pure tape, a hybrid braid, a hybrid weave, a hybrid tape, a commingled braid, a commingled weave, a commingled tape, or the like. The composite aerofoil may include one or more reinforcement architectures. The reinforcement architecture for a region of the composite aerofoil may be selected according to desired properties of that portion of the composite aerofoil, such as mechanical properties.

For example, the composite aerofoil (or a reinforcement architecture in the composite aerofoil) may include a uniform reinforcement architecture. The uniform reinforcement architecture includes a composite material which is substantially consistent mixture of a matrix material, a plurality of relatively higher-modulus reinforcement elements, and a plurality of relatively tougher polymer-based reinforcement elements, e.g., throughout an entire volume of the composite aerofoil. This may provide substantially uniform mechanical properties to the composite aerofoil (or a reinforcement architecture in the composite aerofoil), e.g., substantially uniform stiffness, toughness, and the like.

In some examples, the composite aerofoil may include hybrid reinforcement elements. Hybrid reinforcement elements include first strands of relatively higher-modulus fibers and second strands of relatively tougher polymer-based fibers. The first strands of relatively higher-modulus fibers and second strands of relatively tougher polymer-based fibers are at least one of braided, interwoven, or combined together in parallel within a tape to form a hybrid reinforcement element. For example, a fabric may include warp yarns that include first strands of relatively higher-modulus fibers and a weft yarns that include second strands of relatively tougher polymer-based fibers.

In other examples, the composite aerofoil may include commingled reinforcement elements. Commingled reinforcement elements include strands having both relatively higher-modulus fibers and relatively tougher polymer-based fibers. In some examples, the composite aerofoil may include commingled reinforcement elements in which commingled strands are braided, interwoven, or in a tape together to form a reinforcement element. In other examples, both commingled reinforcement elements (or braids, weaves, tapes, or fabrics that include commingled reinforcement elements) and hybrid reinforcement elements may be incorporated in a reinforcement element of the composite aerofoil. For example, a fabric may include warp yarns that include hybrid reinforcement elements and a weft yarns that include commingled reinforcement elements. As another example, a first fabric layer may include hybrid reinforcement elements and a second fabric layer may include commingled reinforcement elements. Other combinations of hybrid reinforcement elements, commingled reinforcement elements, or both are contemplated.

By including both relatively higher-modulus reinforcement elements and relatively tougher polymer-based reinforcement elements, the composite aerofoil may possess increased toughness (e.g., reduce brittleness) compared to a composite aerofoil that does not include relatively tougher polymer-based reinforcement elements, while still possessing relatively high stiffness and tensile strength. Further, as the relatively tougher polymer-based reinforcement elements may be less dense than the relatively higher-modulus reinforcement elements, the composite aerofoil may be lighter than a similar aerofoil that includes only relatively higher-modulus reinforcement elements.

Figure 2:
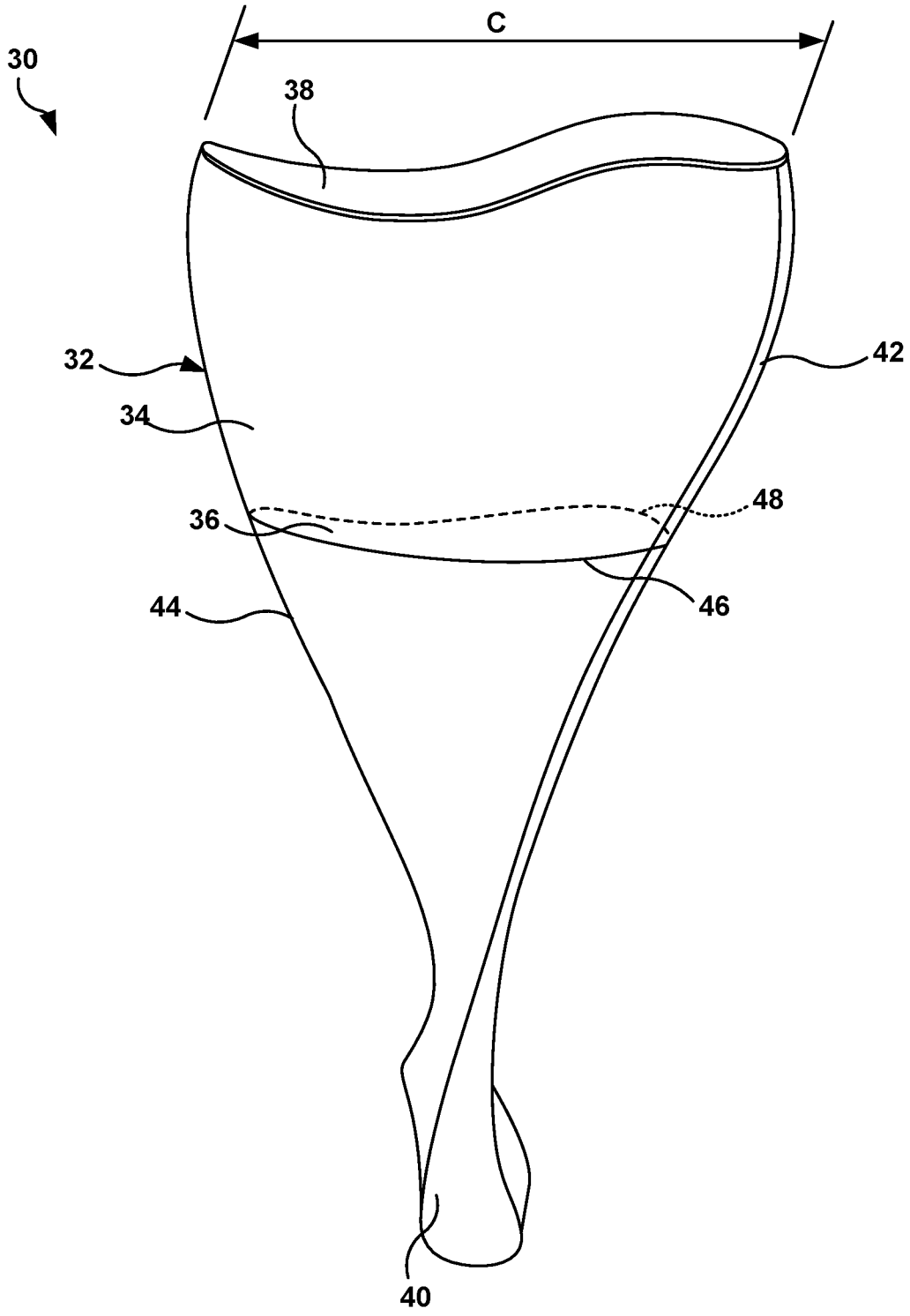
FIG. 2 is a schematic and conceptual diagram illustrating a perspective view of an example composite aerofoil.

FIG. 2 is a schematic and conceptual diagram illustrating a perspective view of an example composite aerofoil 30. Composite aerofoil 30 may be a blade of a fan or propeller or a vane of an outlet guide vane. Composite aerofoil 30 includes a composite material that includes both relatively higher-modulus reinforcement elements and relatively tougher polymer-based reinforcement elements, as described above with reference to FIG. 1. A composite material may provide greater strength (e.g., tensile strength) than a metallic material while also being lighter.

Composite aerofoil 30 includes a body 32. Body 32 defines an outer surface 34 on which air impacts. Body 32 also includes a core region 36. Composite aerofoil 30 extends radially (with reference to the longitudinal axis of gas turbine engine 10) from a tip 38 to a root portion 40, circumferentially from a leading edge 42 to a trailing edge 44, defining a chord C, and axially from a suction surface 46 to a pressure surface 48. Suction surface 46 and pressure surface 48 each extend from leading edge 42 to trailing edge 44. In examples in which composite aerofoil 30 is a rotor blade of a fan, root portion 40 may engage with a rotor disc of the fan to secure composite aerofoil 30 to the rotor disc.

Composite aerofoil 30 may include a matrix material, a plurality of relatively higher-modulus reinforcement elements, and a plurality of relatively tougher polymer-based reinforcement elements. In some examples, composite aerofoil 30 may include at least one first region and at least one second region. The ratio of relatively tougher polymer-based reinforcement elements to relatively higher-modulus reinforcement elements in a given region may range from zero (no relatively tougher polymer-based reinforcement elements and only relatively higher-modulus reinforcement elements) to infinite (only relatively tougher polymer-based reinforcement elements and no relatively higher-modulus reinforcement elements). For example, at least one first region may include a greater ratio of relatively tougher polymer-based reinforcement elements to relatively higher modulus reinforcement elements than a ratio of relatively tougher polymer-based reinforcement elements to relatively higher modulus reinforcement elements in at least one second region.

In some implementations, the at least one first region and the at least one second region may define one or more layers of the composite aerofoil. For example, the body of the composite aerofoil may include a plurality of layers. By including at least one first region and at least one second region, the composite aerofoil may include at least one first region of relatively high stiffness and tensile strength, and at least one second region of increased toughness.

Additionally, or alternatively, the composite aerofoil may include a plurality of reinforcement architectures, such as a first region that includes a first reinforcement architecture and a second region that includes a second reinforcement architecture. The first reinforcement architecture may be selected to provide desired properties to the first region and the second reinforcement architecture may be selected to provide desired properties to the second region. For example, at least one first region may include a greater ratio of relatively tougher polymer-based reinforcement elements to relatively higher modulus reinforcement elements than a ratio of relatively tougher polymer-based reinforcement elements to relatively tougher higher modulus reinforcement elements in at least one second region. In this way, the first region possesses greater toughness than the second region, while the second regions possesses greater stiffness than the first region.

Figure 3:
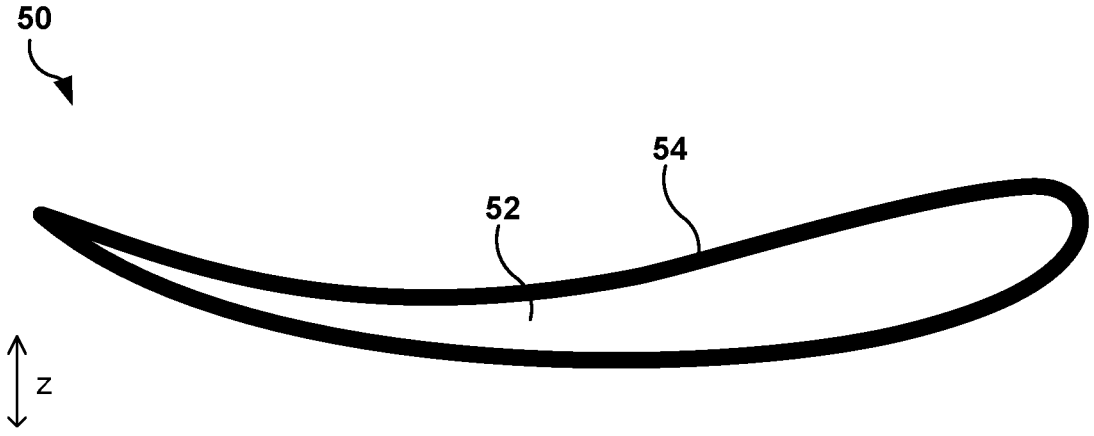
FIG. 3 is a conceptual diagram illustrating a cross-sectional view of an example fan blade.

For instance, as shown in FIG. 3, an aerofoil 50, which may be an example of aerofoil 30, may include a core region 52 including one or more layers and a shell region 54 including one or more layers. Core region 52 may include a first reinforcement architecture and shell region 54 may include a second reinforcement architecture. In some implementations, the first reinforcement architecture may include a lower ratio of relatively tougher polymer-based reinforcement elements to relatively higher modulus reinforcement elements, and the second reinforcement architecture may include a higher ratio of relatively tougher polymer-based reinforcement elements to relatively higher modulus reinforcement elements. In such implementations, core region 52 including the lower ratio of relatively tougher polymer-based reinforcement elements to relatively higher modulus reinforcement elements (a greater proportion of relatively higher modulus reinforcement elements) may provide high stiffness to aerofoil 50, while shell region 54 including the higher ratio of relatively tougher polymer-based reinforcement elements to relatively higher modulus reinforcement elements (a greater proportion of relatively tougher polymer-based reinforcement elements) may provide high toughness, which may help hold together core region 52 in case of foreign object impacts, e.g., for a ran rotor.

In other implementations, the first reinforcement architecture may include a higher ratio of relatively tougher polymer-based reinforcement elements to relatively higher modulus reinforcement elements, and the second reinforcement architecture may include a lower ratio of relatively tougher polymer-based reinforcement elements to relatively higher modulus reinforcement elements. In such implementations, core region 52 including the higher ratio of relatively tougher polymer-based reinforcement elements to relatively higher modulus reinforcement elements (a lower proportion of relatively higher modulus reinforcement elements) may provide high toughness to aerofoil 50, while shell region 54 including the lower ratio of relatively tougher polymer-based reinforcement elements to relatively higher modulus reinforcement elements (a lower proportion of relatively tougher polymer-based reinforcement elements) may provide high stiffness. Such an implementation may result in a stiff, robust, and light aerofoil, e.g., for an outlet guide vane.

Figure 4:
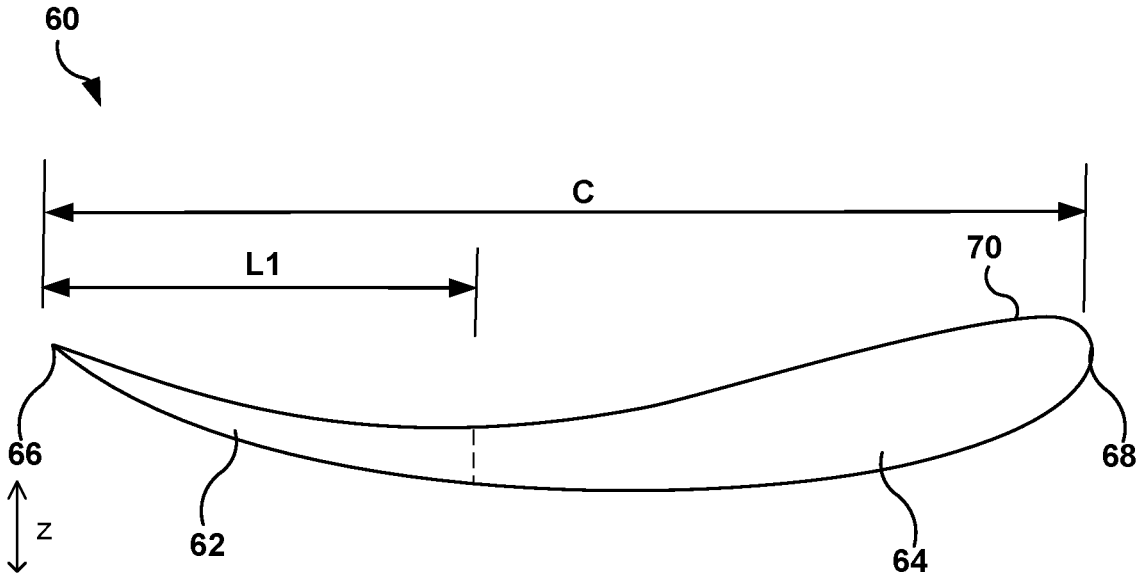
FIG. 4 is a conceptual diagram illustrating another cross-sectional view of an example fan blade.

In some examples, a first region is adjacent and parallel to trailing edge 44 (FIG. 2) and extend partway along the length of chord C, while the second region is adjacent and parallel to leading edge 42. For example, as shown in FIG. 4, an aerofoil 60, which may be an example of aerofoil 30, may include a first region 62 that extends from a trailing edge 66 a first length L1 along chord C and a second region 64 that extends from first region 62 to leading edge 68. First region 62 may include a greater ratio of relatively tougher polymer-based reinforcement elements to relatively higher modulus reinforcement elements compared to second region 64. In this way, first region 62 is tougher than second region 64. This may increase resiliency of first region 62 to foreign object damage. For instance, at least a portion of leading edge 68 (e.g., a pressure side of leading edge 68) may be protected with a coating 70 that provided increased toughness to the coated portion, while the pressure side of first region 62 may be left uncoated. Coating 70 may include a metal or alloy, such as a titanium alloy. Example titanium alloys include Ti64, or titanium alloys that include a lower amount of aluminum, which have improved ductility compared to Ti64.

As shown in FIG. 4, first region 62 may be thinner than second region 64 (e.g., in the z-axis direction of FIG. 4). In implementations in which first region 62 includes only relatively higher modulus reinforcement elements, the combination of the brittleness of the higher modulus reinforcement elements and the relative thinness of first region 62 may result in more severe damage to first region 62 in case of foreign object impact. By including relatively tougher polymer-based reinforcement elements, the toughness of first region 62 (the region adjacent to trailing edge 66) may be improved, increasing resilience of first region 62 to foreign object impact. Further, using relatively tougher polymer-based reinforcement elements rather than glass reinforcement elements may reduce a weight of first region 62 while improving toughness of first region 62.

As described above, composite aerofoil 30 (FIG. 2) may include one or more reinforcement architectures. FIGS. 5-10 are conceptual diagrams illustrating example reinforcement architectures. Each region of composite aerofoil 30 may include different reinforcement architectures, or may include similar reinforcement architectures.

Figure 5:
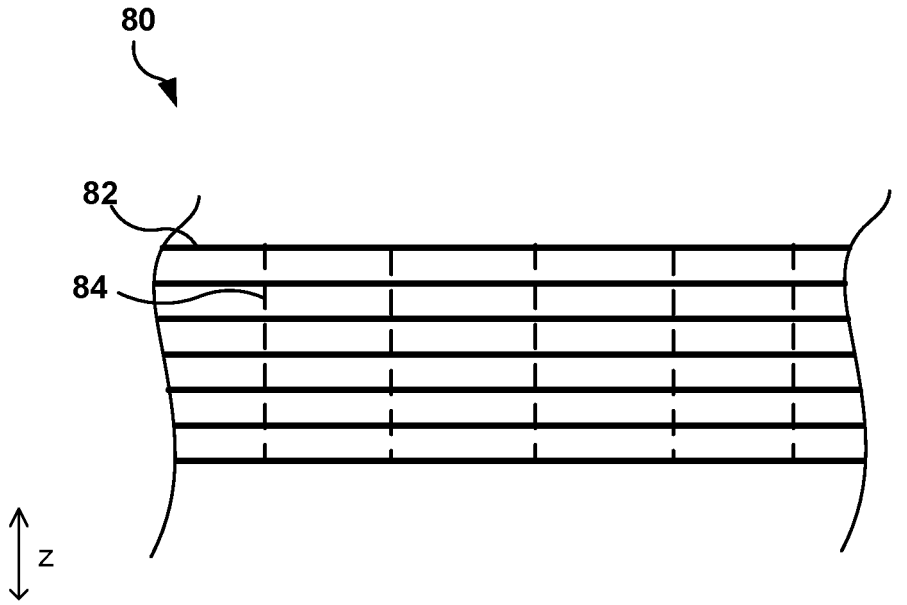
FIGS. 5-10 are conceptual diagrams illustrating example reinforcement architectures for composite aerofoils.

For example, FIG. 5 illustrates a reinforcement architecture 80 that includes a plurality of reinforcement layers 82 and a plurality of z-oriented reinforcement elements 84. Reinforcement layers 82 may include a two-dimensional reinforcement architecture. Reinforcement layers 82 may include relatively high modulus reinforcement elements alone, or intermingled with, braided with, interwoven with, along with the relatively tougher polymer-based reinforcement elements, depending on the particular properties selected for reinforcement architecture 80. As described above, an individual braid, weave, may include a plurality of strands. Each strand of the plurality of strands includes one or more tows (e.g., yarns). Each tow includes a plurality of fibers. A pure braid, pure weave, or pure tape includes only strands having one or more tows that include only fibers of the same material (e.g., only relatively high modulus reinforcement elements or only relatively tough polymer-based reinforcement elements). A hybrid braid, hybrid weave, or hybrid tape include at least one first strand having one or more tows that include fibers of a first material and a second strand having one or more tows that include fibers of a second, different material. A hybrid braid, hybrid weave, or hybrid tape may include more than two types of strands, each strand intermingled by having one or more tows including a different type of fiber. A commingled braid, commingled weave, or commingled tape includes at least one strand having at least one first tow that includes fibers of a first material and at least one second tow that includes fibers of a second, different material. Reinforcement layers 82 may include any combination of pure, hybrid, or commingled braids, weaves, or tapes.

Z-oriented reinforcement elements 84 include a higher ratio of relatively tough polymer-based reinforcement elements to relatively high modulus reinforcement elements than reinforcement layers 82. In some examples, z-oriented reinforcement elements 84 include substantially only relatively tough polymer-based reinforcement elements. In other examples, z-oriented reinforcement elements 84 include a hybrid or commingled strands. In any case, z-oriented reinforcement elements 84 include a higher ratio of relatively tough polymer-based reinforcement elements to relatively high modulus reinforcement elements than reinforcement layers 82.

Z-oriented reinforcement elements 84 are oriented out of the plane defined by reinforcement layers 82. For example, z-oriented reinforcement elements 84 may be oriented substantially perpendicular to reinforcement layers 82. Z-oriented reinforcement elements 84 improve cohesion between adjacent reinforcement layer 82. This may improve resistance to delamination of reinforcement layers 82 upon foreign object impact.

In some examples, reinforcement architecture 80 may be used for all of composite aerofoil 30. In other examples, reinforcement architecture 80 may be used for one or more regions of a composite aerofoil, e.g., core region 52 and/or shell region 54 of aerofoil 50, or first region 62 and/or second region 64 of aerofoil 60.

Figure 6:
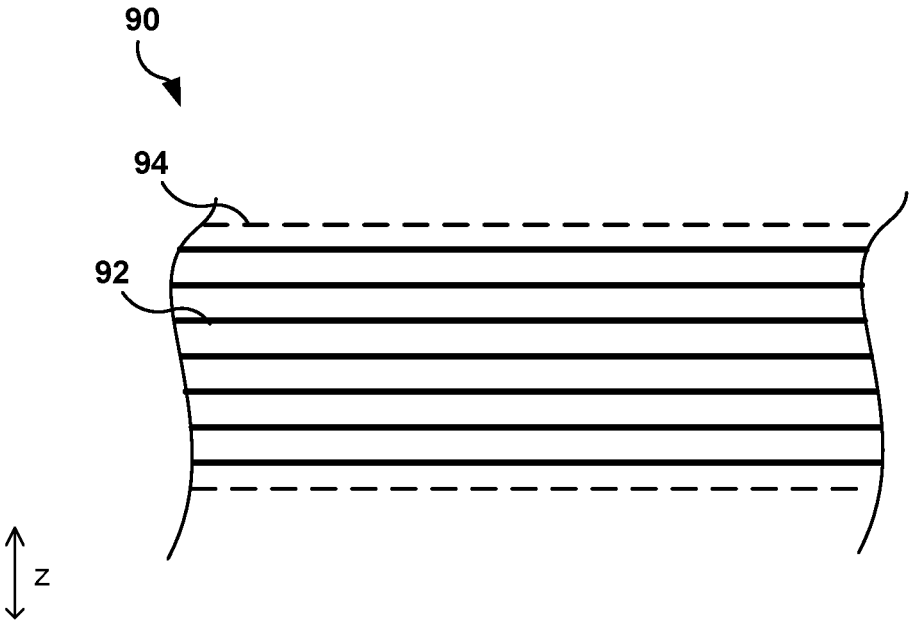

FIG. 6 illustrates a reinforcement architecture 90 that includes a plurality of reinforcement layers 92 and an overbraid 94. Each of reinforcement layer 92 may be similar to or substantially the same at reinforcement layers 82. Overbraid 94 includes a higher ratio of relatively tough polymer-based fibers to relatively high modulus reinforcement fibers than reinforcement layers 92. Like z-oriented reinforcement elements 84, overbraid 94 may include substantially only relatively tough polymer-based reinforcement elements, a hybrid braid, weave, or tape, or a commingled braid, weave, or tape. Also, like z-oriented reinforcement elements 84, overbraid 94 may improve resistance to delamination of reinforcement layers 92 upon foreign object impact. Reinforcement architecture 90 may be used, for example, in aerofoil 50 of FIG. 3.

Figure 7:
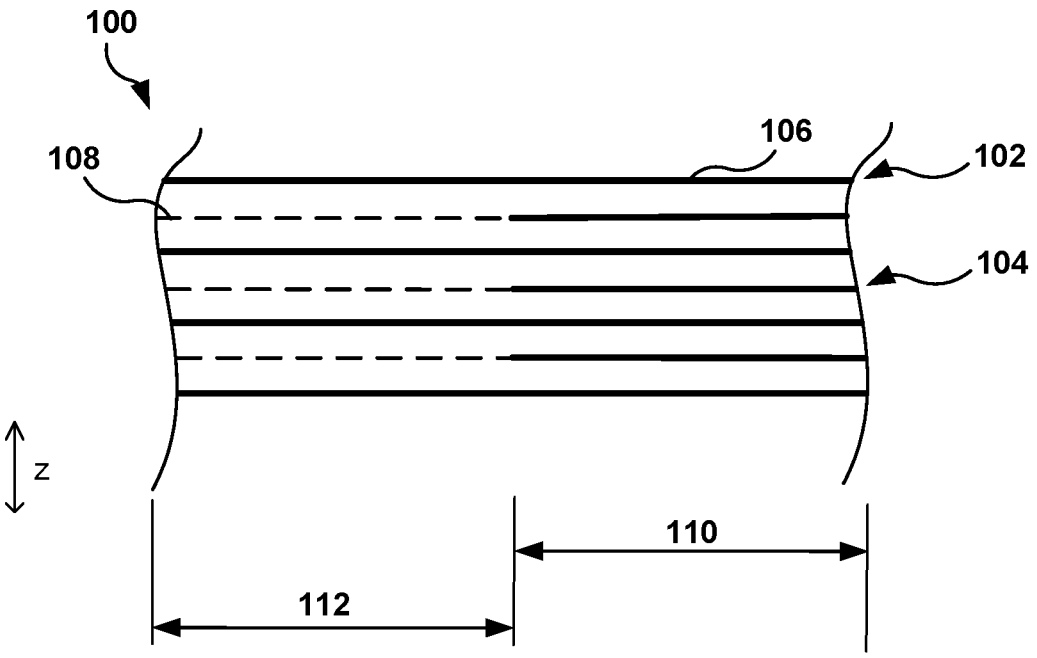

FIG. 7 illustrates a reinforcement architecture 100 that includes a plurality of first layers 102 and a plurality of second layers 104. First layers 102 include a relatively lower ratio of relatively tough polymer-based reinforcement elements to relatively high modulus reinforcement elements throughout the layers 102. Second layers 104 include a first portion 110 that includes a relatively lower ratio of relatively tough polymer-based reinforcement elements to relatively high modulus reinforcement elements and a second portion 112 that includes a relatively higher ratio of relatively tough polymer-based reinforcement elements to relatively high modulus reinforcement elements. As shown in FIG. 7, first layers 102 and second layers 104 are interleaved in a 1:1 ratio. In other examples, first layers 102 and second layers 104 may be interleaved in a different ratio, e.g., 2 first layers 102 for each second layer 104, 2 second layers 104 for each first layer 102, or the like. Further, the ratio of first layers 102 to second layers 104 may change throughout the thickness (in the z-axis direction) of reinforcement architecture 100.

In some examples, reinforcement architecture 100 may be used to transition from region that includes a relatively lower ratio of relatively tough polymer-based reinforcement elements to relatively high modulus reinforcement elements to a region that includes a relatively higher ratio of relatively tough polymer-based reinforcement elements to relatively high modulus reinforcement elements, or vice versa. For instance, as described above with respect to FIG. 4, a first region 62 of aerofoil 60 adjacent to trailing edge 66 may include a higher ratio of relatively tough polymer-based reinforcement elements to relatively high modulus reinforcement elements than second region 64. Reinforcement architecture 100 may be used to transition from first region 62 to second region 64 while maintaining adhesion and cohesion at the interface between the regions.

Figure 8:
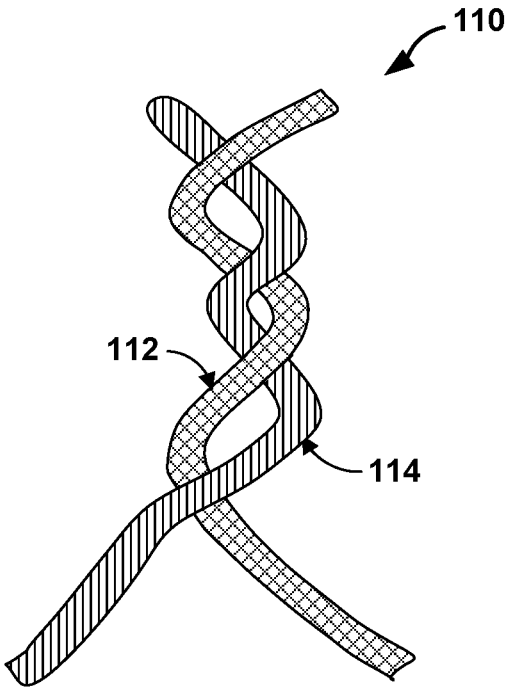

FIG. 8 is a conceptual diagram illustrating an example combined reinforcement 110 that includes a first reinforcing element 112 (e.g., a first strand of a first reinforcing element) and a second reinforcing element 114 (e.g., a second strand of a second different reinforcing element). As discussed above with respect to FIG. 4, first reinforcing element 112 and second reinforcing element 114 may include only relatively higher-modulus reinforcement elements, only relatively tougher polymer-based reinforcement elements, or a selected ratio of both, including, for example, hybrid or commingled reinforcing elements. Although FIG. 8 shows combined reinforcement 110 including first reinforcing element 112 and second reinforcing element 114, a plurality of reinforcing elements may be braided to form combined reinforcement 110. For example, combined reinforcement 110 may include more than two reinforcing elements, such as, tens or hundreds of reinforcing elements. As shown in FIG. 8, combined reinforcement 110 is substantially linear. In other examples, combined reinforcement 110 may include other reinforcing architectures, including, biaxial braid, or triaxial braid. For example, combined reinforcement 110 may define at least a portion of the shape of a body of a composite aerofoil. Any suitable braiding technique may be used to form braid 110 including, but not limited to, 2-D braiding, 3-D braiding, circular braiding, over-braiding, four-step braiding, two-step braiding, rotary braiding, and the like.

Combined reinforcement 110 may improve load distribution compared to other reinforcing architectures (e.g., uniform material, unidirectional tapes, or the like). As one example, combined reinforcement 110 may reduce crack propagation by arresting cracking at the intersection of first reinforcing element 112 and second reinforcing element 114. In this way, by including a combined reinforcement 110 in a composite aerofoil (e.g., a layer or region of the composite aerofoil), the composite aerofoil may be configured to better absorb impacts.

Figure 9A:
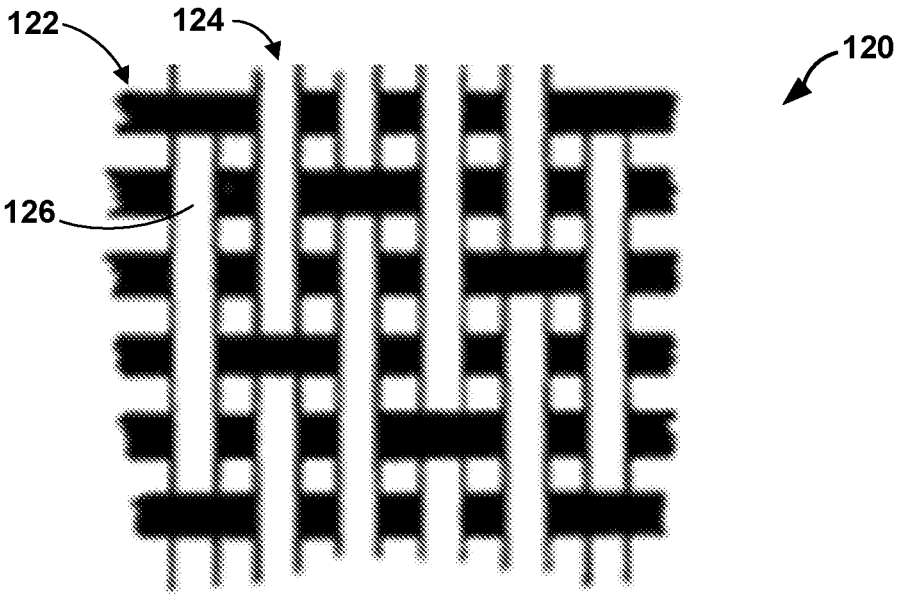

FIG. 9A is a conceptual diagram illustrating an example 5-harness satin weave 120 that includes a woven reinforcement architecture including first reinforcing elements 122 and second reinforcing elements 124. First reinforcing elements 122 include warp yarns of weave 120. Second reinforcing elements 124 include weft yarns (e.g., fill) of weave 120. First reinforcing element 122 and second reinforcing element 124 may intersect at pick 126. In some examples, first reinforcing element 122 and second reinforcing element 124 may include the same material, e.g., relatively higher-modulus reinforcement elements, relatively tougher polymer-based reinforcement elements, or a selected ratio of both, including, for example, hybrid or commingled reinforcing elements. In other examples, first reinforcing element 122 and second reinforcing element 124 may include different materials. For example, first reinforcing element 122 and second reinforcing element 124 may include different relatively higher-modulus reinforcement elements, relatively tougher polymer-based reinforcement elements, or a selected ratio of both, including, for example, hybrid or commingled reinforcing elements. Weave 120 include a 5-harness satin weave, however, weave 120 may include any weave pattern or combination of weave patterns, including, but not limited to, two-by-two twill weave, satin weave, plain weave, leno weave, and other patterned weaves. Additionally, weave 120 may include any suitable thread count. For example, thread count of weave 120 may be greater than ten-by-ten, such as, twenty-by-twenty or thirty-by-thirty. Weave 120 may include tows (e.g., yarns) of any suitable number of fibers per bundle. For example, weave 120 may include greater than 1,000 fibers per bundle (e.g., 1 k tow), greater than 3,000 fibers per bundle (3 k tow), greater than 10,000 fibers per bundle (10 k tow), or greater than 50,000 fibers per bundle (50 k tow).

Weave 120 may improve load distribution compared to other reinforcing architectures (e.g., unidirectional tapes). For example, weave 120 may reduce crack propagation by arresting cracking at a respective pick (e.g., pick 126) of first reinforcing element 122 and second reinforcing element 124. Additionally, or alternatively, weave 120 may include warp yarns, weft yarns, or both that include a selected ratio of relatively higher-modulus reinforcement elements, relatively tougher polymer-based reinforcement elements, or a selected ratio of both (e.g., commingled reinforcing elements). For example, at least a portion of warp yarns or weft yarns may be selected to include a ratio of relatively higher-modulus reinforcement elements, relatively tougher polymer-based reinforcement elements, or both to provide a desired toughness, stiffness, or both in a selected layer or region of a composite aerofoil. In this way, by including weave 120 in a composite aerofoil (e.g., a layer or region of the composite aerofoil), the composite aerofoil may be configured to better absorb impacts or withstand other mechanical forces during operation of a turbine with the composite aerofoil.

Figure 9B:
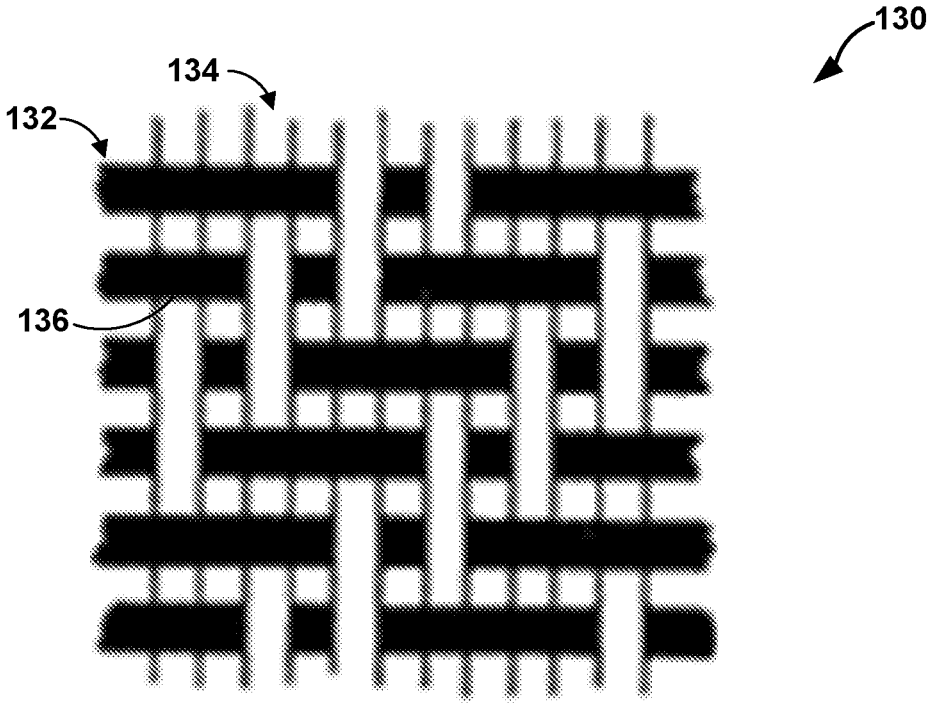

FIG. 9B is a conceptual diagram illustrating an example 2/2 twill weave 130 that includes a woven reinforcement architecture including first reinforcing elements 132 and second reinforcing elements 134 that cross at pick 136. Weave 130 may be the same or substantially similar to weave 120 discussed above, except for the differences described herein. Weave 130 may be the same or substantially similar to weave 120 discussed above, aside from being a 2/2 twill weave 130.

Figure 10:
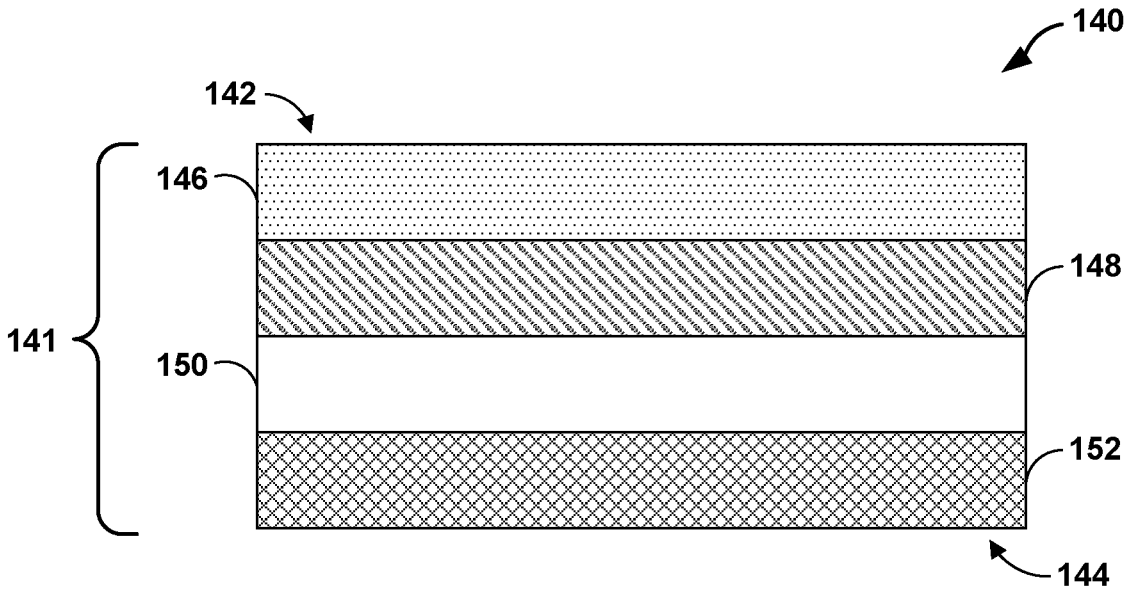

Any one or more reinforcement architectures, including braids, weaves, or tapes, as discussed above, may be combined to form layers or regions of a composite aerofoil. FIG. 10 is a conceptual diagram illustrating an example composite aerofoil portion 140 that includes a plurality of layers 141. In some examples, aerofoil portion 140 may include a respective region of a one or more regions of a composite aerofoil. The plurality of layers 141 define a first major surface 142 and a second major surface 144. For example, first major surface 142 may include an pressure surface of the composite aerofoil or a suction surface of the composite aerofoil, or vice-versa. As shown in FIG. 10, aerofoil portion 140 includes first layer 146, second layer 148, third layer 150, and fourth layer 152. In other examples, aerofoil portion 140 may include few layers or additional layers. Each of first layer 146, second layer 148, third layer 150, and fourth layer 152 may include any of the above-mentioned reinforcement architectures. By enabling selection of different reinforcement architectures for each respective layer of the plurality of layers 142, aerofoil portion 140 may be configured to provide a desired strength, a desired toughness, or both; reduce the weight of an aerofoil, or reduce manufacturing costs.

Figure 11:
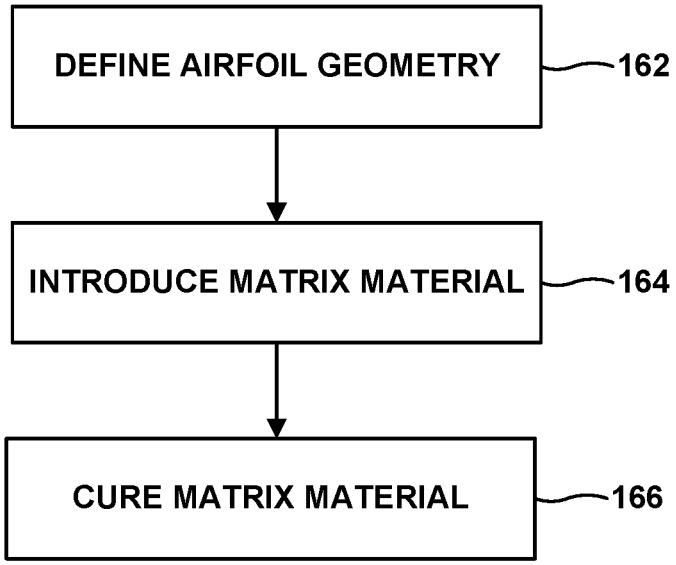
FIG. 11 is a flow diagram illustrating an example technique for forming a composite aerofoil.

The composite aerofoils described herein may be formed using a variety of techniques, including for example, prepreg layup and cure, placement of fibers by overbraiding or 3-D pre-form and then using resin transfer molding, or the like. FIG. 11 is a flow diagram illustrating an example technique for forming a composite aerofoil. The technique of FIG. 11 will be described with reference to aerofoil 30 of FIG. 3, although one of ordinary skill in the art will appreciate that similar techniques may be used to form other aerofoils, e.g., aerofoil 50 of FIG. 3, aerofoil 60 of FIG. 4, and the like.

The technique of FIG. 11 includes defining a geometry of aerofoil 30 (162). The geometry of aerofoil 30 may be defined using one or more techniques. For example, braided, woven, or tape reinforcement elements may be disposed within or about a mold, mandrel, or the like, to define a shape of at least a portion of aerofoil 30. In some examples, two or more of these techniques may be combined to define a geometry of aerofoil 30. For example, braided, woven, or tape reinforcement elements may be laid up in a mold, then it may be overbraided around a the molded core. This would enable a higher cure temperature, high modulus core with a lower cure temperature, higher toughness exterior.

In some examples, defining the geometry of aerofoil 30 (162) may include positioning the reinforcement elements in one or more of selected orientations, selected regions, or both. For example, as described above, in some examples, aerofoil 30 may include a plurality of reinforcement architectures, a plurality of layers, and/or a plurality of regions. In this way, defining the geometry of aerofoil 30 (162) may include positioning the relatively higher-modulus reinforcement elements and the relatively tougher polymer-based reinforcement elements in selected orientations, selected regions of aerofoil 30, or both to define the selected reinforcement architectures as well as layers, regions, or both of a selected strength, toughness, or both.

The technique in FIG. 11 includes introducing a matrix material around the reinforcement elements (164). In some examples, the matrix material (e.g., an uncured form of the matrix material) may be introduced around at least some of the reinforcement elements prior to defining the geometry of aerofoil 30 (164). For example, at least some of the reinforcement elements (relatively higher-modulus reinforcement fibers, relatively tougher polymer-based reinforcement fibers, or both) may be in a braided or woven or tape pre-impregnated reinforcement elements, in which an uncured or partially cured form of the matrix material at least partially surrounds at least a portion of the reinforcement elements. In some examples, the matrix material may be introduced around the reinforcement elements (164) after defining the geometry of aerofoil 30 (162). For example, resin transfer molding may be used to introduce matrix material or a precursor of matrix material into a mold that contains reinforcement elements. In some examples, e.g., examples in which aerofoil 30 includes both pre-impregnated woven as well as tape, 3-D woven pre-form, or overbraided reinforcement elements, matrix material may be introduced both before and after defining the geometry of aerofoil 30 (164).

Once the matrix material is introduced (164), the matrix material may be cured (166). The matrix material may be cured by introducing energy into the matrix material, e.g., via convention, conduction, infrared radiation, ultraviolet radiation, or the like. Curing the matrix material may result in aerofoil 30.

In this way, the technique of FIG. 11 may be used to form a composite aerofoil including a matrix material, relatively higher-modulus reinforcement elements, and relatively tougher polymer-based reinforcement elements. By including relatively higher-modulus reinforcement elements, the composite aerofoils may be relatively lightweight, yet strong to resist forces acting upon the composite aerofoil. By including relatively tougher polymer-based reinforcement elements in addition to relatively higher-modulus reinforcement elements, the composite aerofoil may exhibit increased toughness (e.g., reduced brittleness), which may increase resistance to fracturing when struck by a foreign object, such as birds, hailstones, or the like.

Clause 1: A composite aerofoil comprising: an aerofoil body defining a leading edge and a trailing edge, wherein the body comprises a composite material including a plurality of relatively higher-modulus reinforcement elements, a plurality of relatively tougher polymer-based reinforcement elements, and a matrix material substantially encapsulating the plurality of relatively higher-modulus reinforcement elements and the plurality of relatively tougher polymer-based reinforcement elements, wherein the plurality of relatively higher-modulus reinforcement elements are different from the plurality of relatively tougher polymer-based reinforcement elements.

Clause 2: The composite aerofoil of clause 1, wherein the aerofoil body includes a first region and a second region separate from the first region, the second region defining the trailing edge, wherein the first region comprises a lesser ratio of relatively tougher polymer-based reinforcement elements to relatively higher-modulus reinforcement elements than a ratio of relatively tougher polymer-based reinforcement elements to relatively higher-modulus reinforcement elements in the second region.

Clause 3: The composite aerofoil of clause 1, wherein the aerofoil body includes a core region surrounded by an outer skin region, wherein the core region includes the plurality of tougher polymer-based reinforcement elements and the outer skin region includes the plurality of relatively higher-modulus reinforcement elements.

Clause 4: The composite aerofoil of clause 3, wherein the matrix material comprises a first matrix material formed by a first resin and a second matrix material formed by a second resin, wherein the core region includes the first matrix material and the outer skin region includes the second matrix material.

Clause 5: The composite aerofoil of clause 1, wherein the aerofoil body includes a core region including the plurality of relatively higher-modulus reinforcement elements, wherein the core region is surrounded by an over-braid including the plurality of tougher polymer-based reinforcement elements.

Clause 6: The composite aerofoil of clause 1, wherein the aerofoil body includes a plurality of layers including the plurality of relatively higher-modulus reinforcement elements, and a plurality of z-pins extending at least partially through the plurality of layers, the z-pins including the plurality of tougher polymer-based reinforcement elements.

Clause 7: The composite aerofoil of clause 1, wherein the aerofoil body includes a 3D woven reinforcement architecture.

Clause 8: The composite aerofoil of any one of clauses 1 to 7, wherein the plurality of relatively higher-modulus reinforcement elements comprise relatively higher-modulus filaments, wherein the plurality of relatively tougher polymer-based reinforcement elements comprise relatively tougher polymer-based filaments, and wherein the relatively higher-modulus filaments and relatively tougher polymer-based filaments are together in a hybrid or commingled braid, a hybrid or commingled weave, or a commingled tape.

Clause 9: The composite aerofoil of any one of clauses 1 to 8, wherein the aerofoil body is configured as a fan blade, an outlet guide vane, an inlet guide vane, an integrated strut-vane nozzle, or a propeller for an aircraft.

Clause 10: The composite aerofoil of any one of clauses 1 to 9, wherein the plurality of relatively higher-modulus reinforcement elements have a tensile modulus of greater than 60 GPa and an elongation at break of less than 6.0%.

Clause 11: The composite aerofoil of any one of clauses 1 to 10, wherein the plurality of relatively higher-modulus reinforcement elements have a tensile modulus of greater than 180 GPa and an elongation at break of less than 6.0%.

Clause 12: The composite aerofoil of any one of clauses 1 to 11, wherein the plurality of relatively higher-modulus reinforcement elements comprise at least one of an aromatic polyamide, a carbon fiber, E-glass, or S-glass.

Clause 13: The composite aerofoil of any one of clauses 1 to 12, wherein the plurality of relatively tougher polymer-based reinforcement elements have an elongation at break of greater than 6.0%.

Clause 14: The composite aerofoil of clause 13, wherein the plurality of relatively tougher polymer-based reinforcement elements comprise at least one of a polyamide, a polyester, a polyester terephthalate, a polypropylene, a polyethylene, or a spider silk.

Clause 15: The composite aerofoil of any one of clauses 1 to 14, wherein the matrix material comprises a thermoset polymer.

Clause 16: A method of constructing a composite aerofoil, the method comprising: defining an aerofoil body shape with a matrix material, a plurality of relatively higher-modulus reinforcement elements, and a plurality of relatively tougher polymer-based reinforcement elements, wherein the plurality of relatively higher-modulus reinforcement elements are different from the plurality of relatively tougher polymer-based reinforcement elements, and wherein the aerofoil body is configure to define a leading edge and a trailing edge; and curing the matrix material substantially encapsulating the plurality of relatively higher-modulus reinforcement elements and the plurality of relatively tougher polymer-based reinforcement elements to form the aerofoil body.

Clause 17: The method of clause 16, defining the aerofoil body shape comprises defining an aerofoil body shape that includes a first region and a second region separate from the first region, the second region defining the trailing edge, wherein the first region comprises a lesser ratio of relatively tougher polymer-based reinforcement elements to relatively higher-modulus reinforcement elements than a ratio of relatively tougher polymer-based reinforcement elements to relatively higher-modulus reinforcement elements in the second region.

Clause 18: The method of clause 16, wherein defining the aerofoil body shape comprises defining an aerofoil body shape that includes a core region surrounded by an outer skin region, wherein the core region includes the plurality of tougher polymer-based reinforcement elements and the outer skin region includes the plurality of relatively higher-modulus reinforcement elements.

Clause 19: The method of clause 18, wherein the matrix material comprises a first matrix material formed by a first resin and a second matrix material formed by a second resin, wherein the core region includes the first matrix material and the outer skin region includes the second matrix material.

Clause 20: The method of clause 16, wherein defining the aerofoil body shape comprises defining an aerofoil body shape that includes a core region including the plurality of relatively higher-modulus reinforcement elements, wherein the core region is surrounded by an over-braid including the plurality of tougher polymer-based reinforcement elements.

Clause 21: The method of clause 16, defining the aerofoil body shape comprises defining an aerofoil body shape that includes a plurality of layers including the plurality of relatively higher-modulus reinforcement elements, and a plurality of z-pins extending at least partially through the plurality of layers, the z-pins including the plurality of tougher polymer-based reinforcement elements.

Clause 22: The method of clause 16, defining the aerofoil body shape comprises defining an aerofoil body shape that includes a 3D woven reinforcement architecture.

Clause 23: The method of any one of clauses 16 to 22, wherein the plurality of relatively higher-modulus reinforcement elements comprise relatively higher-modulus filaments, wherein the plurality of relatively tougher polymer-based reinforcement elements comprise relatively tougher polymer-based filaments, and wherein the relatively higher-modulus filaments and relatively tougher polymer-based filaments are together in a hybrid or commingled braid, a hybrid or commingled weave, or a commingled tape.

Clause 24: The method of any one of clauses 16 to 23, wherein the aerofoil body is configured as a fan blade, an outlet guide vane, an inlet guide vane, an integrated strut-vane nozzle, or a propeller for an aircraft.

Clause 25: The method of any one of clauses 16 to 24, wherein the plurality of relatively higher-modulus reinforcement elements have a tensile modulus of greater than 60 GPa and an elongation at break of less than 6.0%.

Clause 26: The method of any one of clauses 16 to 24, wherein the plurality of relatively higher-modulus reinforcement elements have a tensile modulus of greater than 180 GPa and an elongation at break of less than 6.0%.

Clause 27: The method of any one of clauses 16 to 26, wherein the plurality of relatively higher-modulus reinforcement elements comprise at least one of an aromatic polyamide, a carbon fiber, E-glass, or S-glass.

Clause 28: The method of any one of clauses 16 to 27, wherein the plurality of relatively tougher polymer-based reinforcement elements have an elongation at break of greater than 6.0%.

Clause 29: The method of clause 28, wherein the plurality of relatively tougher polymer-based reinforcement elements comprise at least one of a polyamide, a polyester, a polyester terephthalate, a polypropylene, a polyethylene, or a spider silk.

Clause 30: The method of any one of clauses 16 to 29, wherein the matrix material comprises a thermoset polymer.

Various examples have been described. These and other examples are within the scope of the following claims.

What is claimed is:

1. A composite aerofoil comprising: an aerofoil body defining a leading edge and a trailing edge, wherein the body comprises a composite material including a plurality of relatively higher-modulus reinforcement elements, a plurality of relatively tougher polymer-based reinforcement elements, and a matrix material substantially encapsulating the plurality of relatively higher-modulus reinforcement elements and the plurality of relatively tougher polymer-based reinforcement elements, wherein the plurality of relatively higher-modulus reinforcement elements are different from the plurality of relatively tougher polymer-based reinforcement elements, wherein the plurality of relatively higher-modulus reinforcement elements exhibit a higher tensile modulus than the plurality of relatively tougher polymer-based reinforcement elements, wherein the plurality of relatively tougher polymer-based reinforcement elements exhibit a greater toughness than the plurality of relatively higher-modulus reinforcement elements, and wherein the aerofoil body includes: a core region including a plurality of layers stacked on each other, the plurality of layers including the relatively higher-modulus reinforcement elements, and a shell region over the core region, the shell region including the plurality of tougher polymer-based reinforcement elements, and a plurality of z-oriented reinforcement elements extending at least partially through the plurality of layers, the z-oriented reinforcement elements including the plurality of tougher polymer-based reinforcement elements, and wherein the z-oriented reinforcement elements are oriented out of a plane defined by the plurality of layers.

2. The composite aerofoil of claim 1, wherein the core region of the aerofoil body includes a first region and a second region separate from the first region, the second region defining the trailing edge, wherein the first region comprises a lesser ratio of relatively tougher polymer-based reinforcement elements to relatively higher-modulus reinforcement elements than a ratio of relatively tougher polymer-based reinforcement elements to relatively higher-modulus reinforcement elements in the second region.

3. The composite aerofoil of claim 1, wherein the matrix material comprises a first matrix material formed by a first resin and a second matrix material formed by a second resin, wherein the core region includes the first matrix material and the shell region includes the second matrix material.

4. The composite aerofoil of claim 1, wherein the z-oriented reinforcement elements include a higher ratio of the plurality of tougher polymer-based reinforcement elements to the plurality of relatively higher-modulus reinforcement elements compared to the plurality of layers.

5. The composite aerofoil of claim 1, wherein the aerofoil body includes a 3D woven reinforcement architecture.

6. The composite aerofoil of claim 1, wherein the plurality of relatively higher-modulus reinforcement elements comprise relatively higher-modulus filaments, wherein the plurality of relatively tougher polymer-based reinforcement elements comprise relatively tougher polymer-based filaments, and wherein the shell region includes the relatively higher-modulus filaments and relatively tougher polymer-based filaments together in a hybrid or commingled braid, a hybrid or commingled weave, or a commingled tape.

7. The composite aerofoil of claim 1, wherein the aerofoil body is configured as a fan blade, an outlet guide vane, an inlet guide vane, an integrated strut-vane nozzle, or a propeller for an aircraft.

8. The composite aerofoil of claim 1, wherein the plurality of relatively higher-modulus reinforcement elements have a tensile modulus of greater than 60 GPa and an elongation at break of less than 6.0%.

9. The composite aerofoil of claim 1, wherein the plurality of relatively higher-modulus reinforcement elements have a tensile modulus of greater than 180 GPa and an elongation at break of less than 6.0%.

10. The composite aerofoil of claim 1, wherein the plurality of relatively higher-modulus reinforcement elements comprise at least one of an aromatic polyamide, a carbon fiber, E-glass, or S-glass.

11. The composite aerofoil of claim 1, wherein the plurality of relatively tougher polymer-based reinforcement elements have an elongation at break of greater than 6.0%.

12. The composite aerofoil of claim 11, wherein the plurality of relatively tougher polymer-based reinforcement elements comprise at least one of a polyamide, a polyester, a polyester terephthalate, a polypropylene, a polyethylene, or a spider silk.

13. The composite aerofoil of claim 1, wherein the core region comprises a lesser ratio of relatively tougher polymer-based reinforcement elements to relatively higher-modulus reinforcement elements and the shell region comprises a higher a ratio of relatively tougher polymer-based reinforcement elements to relatively higher-modulus reinforcement elements.

14. The aerofoil of claim 1, wherein the shell region includes a braided layer over the core region, the braided layer including a higher ratio of the plurality of tougher polymer-based reinforcement elements to the plurality of relatively higher-modulus reinforcement elements compared to the core region.

15. A method of constructing a composite aerofoil, the method comprising: defining an aerofoil body shape with a matrix material, a plurality of relatively higher-modulus reinforcement elements, and a plurality of relatively tougher polymer-based reinforcement elements, wherein the plurality of relatively higher-modulus reinforcement elements are different from the plurality of relatively tougher polymer-based reinforcement elements, wherein the plurality of relatively higher-modulus reinforcement elements exhibit a higher tensile modulus than the plurality of relatively tougher polymer-based reinforcement elements, wherein the plurality of relatively tougher polymer-based reinforcement elements exhibit a greater toughness than the plurality of relatively higher-modulus reinforcement elements, and wherein the aerofoil body includes a core region including the plurality of relatively higher-modulus reinforcement elements, and a shell region over the core region, the shell region including the plurality of tougher polymer-based reinforcement elements, and wherein the aerofoil body is configured to define a leading edge and a trailing edge; and curing the matrix material substantially encapsulating the plurality of relatively higher-modulus reinforcement elements and the plurality of relatively tougher polymer-based reinforcement elements to form the aerofoil body, and stacking a plurality of layers on each other, the plurality of layers including the plurality of relatively higher-modulus reinforcement elements, and extending a plurality of z-oriented reinforcement elements at least partially through the plurality of layers, the z-oriented reinforcement elements including a higher ratio of the plurality of tougher polymer-based reinforcement elements to the plurality of relatively higher-modulus reinforcement elements compared to the plurality of layers, and wherein the z-oriented reinforcement elements are oriented out of a plane defined by the plurality of layers.

16. The method of claim 15, defining the aerofoil body shape comprises defining the core region of the aerofoil body to include a first region and a second region separate from the first region, the second region defining the trailing edge, wherein the first region comprises a lesser ratio of relatively tougher polymer-based reinforcement elements to relatively higher-modulus reinforcement elements than a ratio of relatively tougher polymer-based reinforcement elements to relatively higher-modulus reinforcement elements in the second region.

17. The method of claim 15, wherein defining the aerofoil body shape comprises:

defining the core region including the plurality of relatively higher-modulus reinforcement elements, and forming the shell region over the core region.

18. A composite aerofoil comprising:

an aerofoil body defining a leading edge and a trailing edge, wherein the body comprises a composite material including a plurality of relatively higher-modulus reinforcement elements, a plurality of relatively tougher polymer-based reinforcement elements, and a matrix material substantially encapsulating the plurality of relatively higher-modulus reinforcement elements and the plurality of relatively tougher polymer-based reinforcement elements, wherein the plurality of relatively higher-modulus reinforcement elements are different from the plurality of relatively tougher polymer-based reinforcement elements, wherein the plurality of relatively higher-modulus reinforcement elements exhibit a higher tensile modulus than the plurality of relatively tougher polymer-based reinforcement elements, wherein the plurality of relatively tougher polymer-based reinforcement elements exhibit a greater toughness than the plurality of relatively higher-modulus reinforcement elements, and wherein the aerofoil body includes:

a core region including of a plurality of layers stacked on each other, the plurality of layers including the plurality of relatively higher-modulus reinforcement elements, and a plurality of z-oriented reinforcement elements extending at least partially through the plurality of layers, the z-oriented reinforcement elements including the plurality of tougher polymer-based reinforcement elements, and wherein the z-oriented reinforcement elements are oriented out of a plane defined by the plurality of layers.

19. The composite aerofoil of claim 18, wherein the z-oriented reinforcement elements includes a higher ratio of the plurality of tougher polymer-based reinforcement elements to the plurality of relatively higher-modulus reinforcement elements compared to the plurality of layers of the core region.

* * * * *